United States Patent [19]

Andrews

[11] Patent Number: 4,726,555

[45] Date of Patent: Feb. 23, 1988

[54] VERTICALLY AND HORIZONTALLY ADJUSTABLE EASEL

[76] Inventor: Donald L. Andrews, P.O. Box 10129, Scottsdale, Ariz. 85271-0129

[21] Appl. No.: 946,982

[22] Filed: Dec. 29, 1986

[51] Int. Cl.[4] ..... A47B 97/04

[52] U.S. Cl. ..... 248/451; 248/124; 248/287; 248/297.1

[58] Field of Search ..... 248/451, 441.1, 447.1, 248/455, 287, 297.1, DIG. 13, 660, 661, 122, 123.1, 124; 269/71; 182/37, 39, 38

[56] References Cited

U.S. PATENT DOCUMENTS

| | | | |
|---|---|---|---|
| 679,529 | 7/1901 | Hitchcock . | |
| 735,346 | 8/1903 | Dean | 248/455 |
| 1,369,748 | 2/1921 | Karro | 248/297.1 |
| 1,699,544 | 1/1929 | Rohlfing | 182/37 X |
| 2,059,525 | 11/1936 | Huelsdonk | 248/195 |
| 3,020,015 | 2/1962 | Seplavy | 248/123.1 |
| 3,416,764 | 12/1968 | Bier | 248/452 |
| 3,809,354 | 5/1974 | Phifer | 248/449 |
| 3,926,398 | 12/1975 | Vincent | 248/448 |
| 4,109,892 | 8/1978 | Hartung | 248/449 |
| 4,134,614 | 1/1979 | Fielding, Sr. | 248/448 |
| 4,145,021 | 3/1979 | Gaechter et al. | 248/371 |
| 4,165,856 | 8/1979 | Wiseheart | 248/458 |
| 4,396,092 | 8/1983 | Thompson | 182/38 |
| 4,566,325 | 1/1986 | Rante | 248/287 X |
| 4,568,052 | 2/1986 | Solomon et al. | 248/281 |
| 4,588,346 | 5/1986 | Smith | 269/71 X |

FOREIGN PATENT DOCUMENTS

| | | | |
|---|---|---|---|
| 7907 | 10/1840 | France | 248/441.1 |
| 590424 | 7/1947 | United Kingdom | 182/37 |

*Primary Examiner*—J. Franklin Foss
*Assistant Examiner*—David L. Talbott
*Attorney, Agent, or Firm*—Cahill, Sutton & Thomas

[57] ABSTRACT

A large floor-to-ceiling easel structure includes a horizontal track on which a pair of rollers horizontally move, supporting a horizontally movable first carriage. The first carriage includes a pair of vertical guides in which a vertically movable second carriage with a movable picture support is disposed. The second carriage is connected by a pair of cables passing over respective sets of pulleys of the first carriage to a counterweight platform on which a sufficient number of counterweights are placed to counterbalance the weight of the second carriage, picture support, and a painting canvas supported thereon. An artist then can remain seated in front of a very large painting canvas, and can, with a slight force, move the painting canvas both vertically and horizontally to position any point of the canvas immediately in front of him.

14 Claims, 11 Drawing Figures

FIG. 3
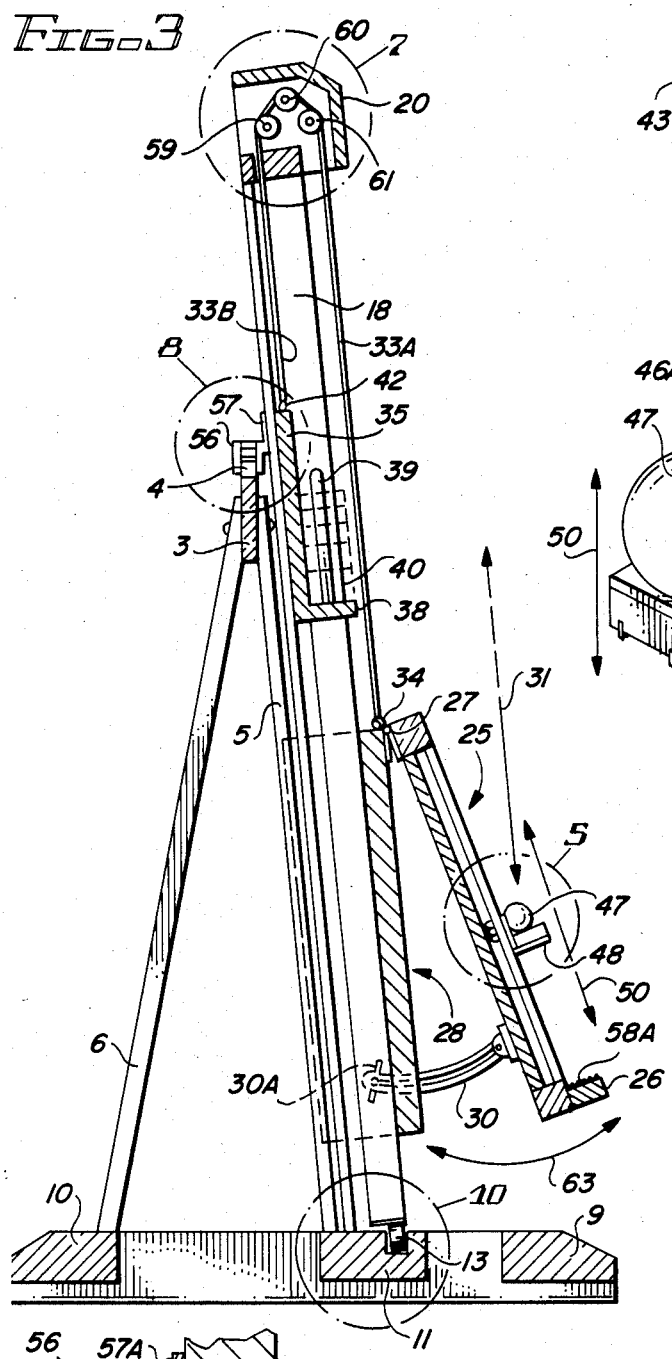
FIG. 4
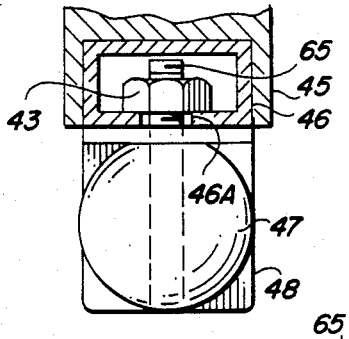
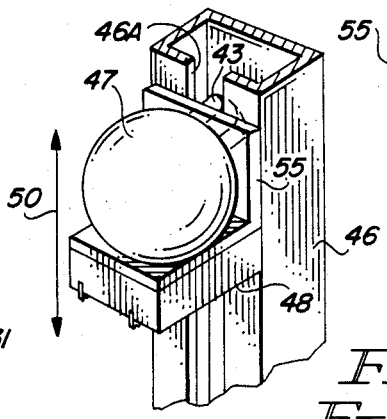
FIG. 5
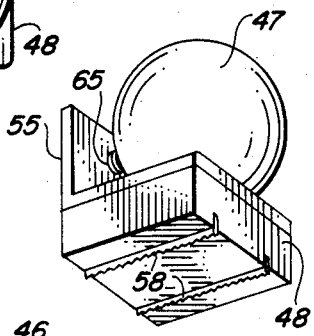
FIG. 6
FIG. 7
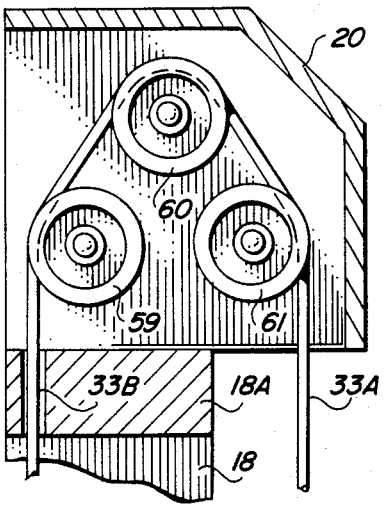
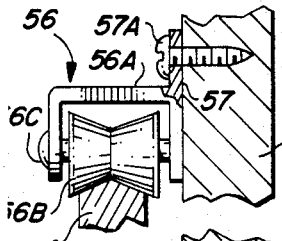
FIG. 8
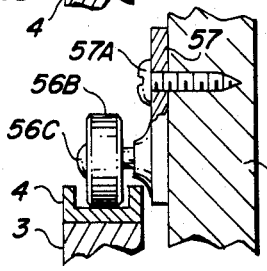
FIG. 9
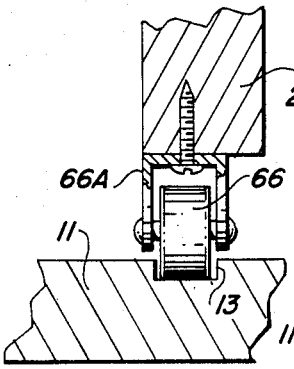
FIG. 10
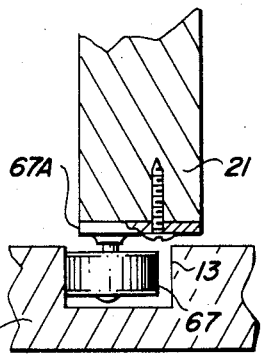
FIG. 11

VERTICALLY AND HORIZONTALLY ADJUSTABLE EASEL

BACKGROUND OF THE INVENTION

The invention relates to easels for supporting painting canvases, and more particularly to an easel structure and method that enables a painter to easily move a very large painting canvas both horizontally and vertically to position a particular portion thereof directly in front of him.

Quite a variety of easels for supporting painting canvases in front of artists are known in the art. The state-of-the-art is generally indicated by U.S. Pat. Nos. 679,529, 2,059,525, 3,416,764, 3,809,354, 3,926,398, 4,109,892, 4,134,614, 4,145,021, 4,165,856, 4,568,052 and French Patent dated Oct. 20, 1840.

Various degrees of adjustability are provided in the easels disclosed in the above-indicated references. For example, the easel disclosed in U.S. Pat. No. 4,109,892 can easily accommodate and securely clamp different size painting canvases, and is adjustable toward or away from the artist. Patents 4,134,614 and 4,165,856 disclose easels with rotatable mobility about a base. U.S. Pat. No. 4,134,614 discloses adjustable utility shelves. U.S. Pat. No. 4,568,052 discloses an adjustable bracket similar to those used to support drafting lamps; this device, however, would be very unsuitable for supporting large painting canvases, as it would not provide the necessary rigidity to resist being jarred when the canvas is touched, for example, by an artist's painting knife.

None of the above-described easels are suitable for supporting very large painting canvases, such as canvases measuring four or five feet on a side. When such a large painting is desired, the artist must move sideways and reach high or low to conveniently paint various sections of the large canvas. If he wishes to raise or lower the picture to enable him to conveniently reach the higher or lower portions of the canvas, he must remove the canvas from the prior easels, loosen slidable clamps, readjust them, and reposition the painting canvas on the picture support members. It would be very convenient if the painter did not have to go through such effort, and instead could easily position any particular area of a large canvas in front of him.

SUMMARY OF THE INVENTION

Accordingly, it is an object of the invention to provide an improved easel that allows convenient vertical and horizontal movement of a large painting canvas. It is another object of the invention to provide an improved easel that permits movement of a supported canvas without loosening, lateral sliding, and retightening of clamping mechanisms.

Briefly described, and in accordance with one embodiment thereof, the invention provides an easel having a base that supports an elevated horizontal rail or track on which a pair of rollers supporting a horizontally movable first carriage can easily be moved to the right or left of an artist standing in front of the easel. The first carriage includes a vertical track or guide in which a second carriage with a picture support assembly can move relatively freely in a vertical direction, supporting a large frame-supported canvas. In the described embodiment of the invention, the second carriage is supported in the vertical tracks of the first carriage by a pulley and cable assembly in which one end of a cable supports the picture support assembly and the other end of the cable supports a counterweight. The pulleys are supported by the first carriage. The amount of counterweight is adjustable to just offset the weight of the second carriage the picture support assembly, and the frame supported thereon, so that the second carriage, picture support assembly, and frame thereon will remain in any vertical position to which they are moved. The plane of the painting canvas is adjustable about a horizontal axis by adjustment of an arcuate bracket and clamp. An artist sitting in front of the easel supporting the canvas can easily move any portion of the canvas to a location directly in front of him by simply grasping an edge of the canvas or a nearby portion of the picture support assembly and urging it vertically and horizontally so as to position the desired area of the canvas directly in front of him, without the need for the artist to move to another location to work on another area of the canvas.

BRIEF DESCRIPTION OF THE DRAWINGS

FIG. 3 is a section view of a slightly modified version of FIG. 1 in which the carriage is slightly inclined, rather than vertical, and is useful in describing the features of FIG. 1.

FIG. 4 is a partial top view diagram useful in describing the painting canvas clamp assembly of the easel of FIG. 1.

FIG. 5 is a partial perspective enlarged view of detail 5 of FIG. 3.

FIG. 6 is a partial perspective view illustrating the lower portion of the painting canvas clamp assembly of detail 5 of FIG. 3.

FIG. 7 is an enlarged view of detail 7 of FIG. 3.

FIG. 8 is an enlarged view of detail 8 of FIG. 3.

FIG. 9 is an enlarged view of an alternate embodiment of detail 8 of FIG. 3.

FIG. 10 is an enlarged view of detail 10 of FIG. 3.

FIG. 11 is an enlarged view of an alternate embodiment of detail 10 of FIG. 3.

Figure 1:
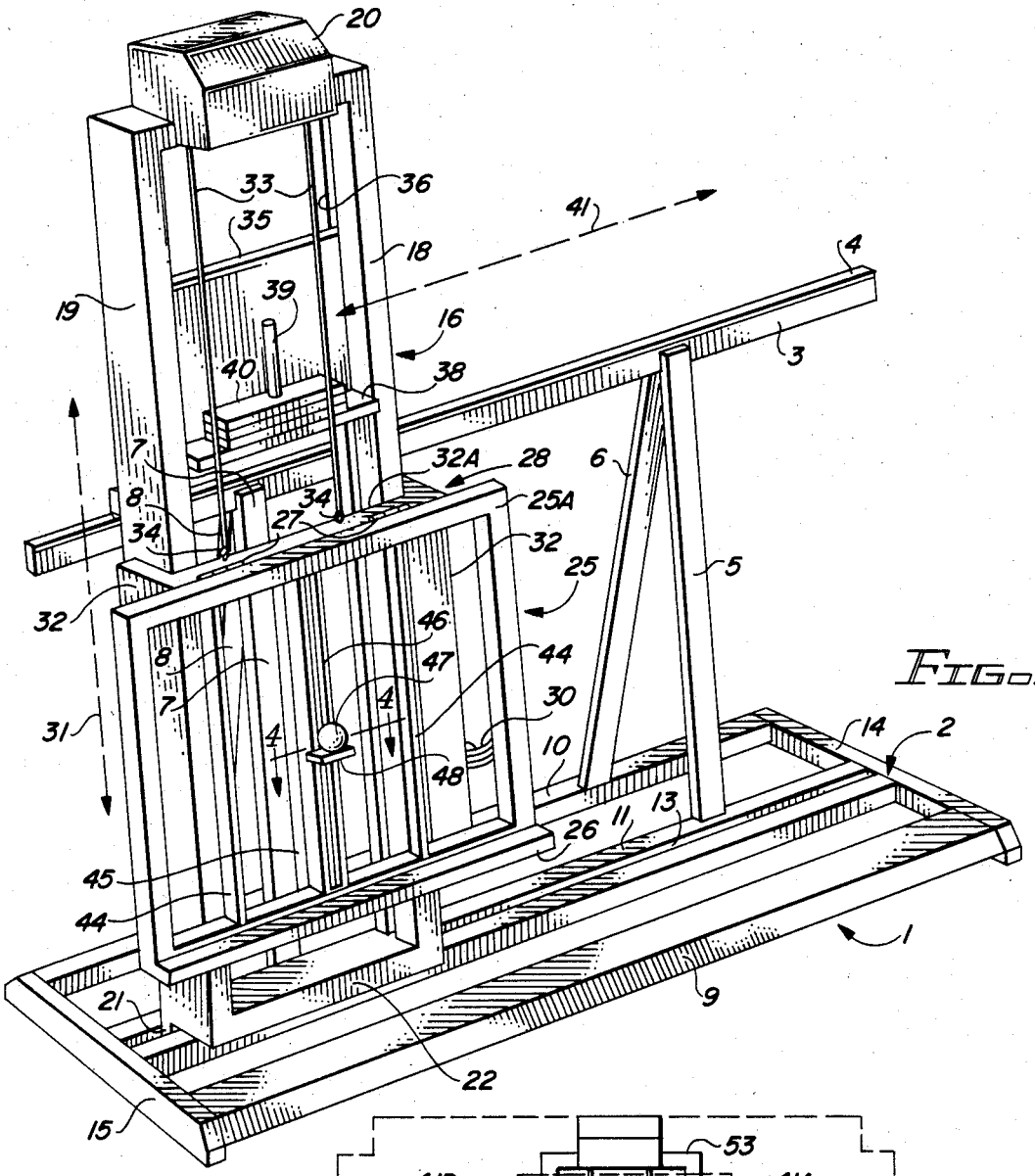
FIG. 1 is a perspective view of the adjustable easel of the present invention.

The invention will be better understood with reference to the attached drawings and the following detailed description.

DETAILED DESCRIPTION OF THE INVENTION

Referring now to the drawings, easel 1 includes a base 2 supporting a horizontal rail 3 by means of vertical struts 5 and 7 and inclined struts 6 and 8. A precision horizontal track 4 is supported on top of rail 3.

Base 2 includes a front member 9, a rear member 10, and a middle member 11 having a longitudinal guide groove 13 therein. Members 9, 10, and 11 are attached to transverse end members 14 and 15. Struts 6 and 8 extend between rail 3 and member 10. Struts 5 and 7 extend between horizontal rail 3 and member 13.

In accordance with an important aspect of the present invention, a horizontally movable carriage 16 rides horizontally in the directions of arrows 41 on precision track 4. As shown in detail 8 of FIG. 3, each of a pair of roller assemblies 56 includes a roller 56B that rides directly on the upper surface of track 4. If desired, the roller 56B can have the grooved configuration shown in FIG. 8. Roller 56B is rotatably supported on a pin supported by a bracket 56A, which in turn is attached by a plate 57 to the back surface of upright 18 or 19 of carriage 6 by means of suitable screws 57A or the like. (Alternately, track 4 can have the inverted U-channel configuration shown in FIG. 9, with roller 56B supported rotatably on pins 56C attached by means of plate 57 and screw 57A to the back of upright 18 or 19 of carriage 16.)

A vertically movable carriage 28 is supported on horizontally movable carriage 16. Vertically movable carriage 28 has a pair of outer uprights or guide members 32 that lightly engage the left side of upright 19 and the right side of upright 18. A horizontal member 32A extends between and is supported by upright members or guides 32. A similar spanner (not shown) extends between the bottom ends of upright members 32 of vertically movable carriage 28.

Vertically movable carriage 28 is supported by a pair of cables 33. One end of each of cables 33 is connected to an eyelet 34 attached to upper spanner 32A. As shown in FIG. 3, each of the cables 33 has a front portion 33A, which is connected to the eyelets 34 and a rear portion 33B on the opposite side of a pulley assembly 59, 60, 61 connected to an eyelet 42 supporting a counterweight support member 35, 38. The pulley assemblies include a rear pulley 59, a top pulley 60, and a front pulley 61 over which a cable 33 passes. The three pulleys are supported within the housing 20, rather than using a single large pulley, to reduce the overall heighth of the easel, so that it will easily fit within a room having a conventional eight foot high ceiling. The housing 20 is rigidly attached to the tops of the uprights 18 and 19 of the first carriage 16.

The counterweight support 35, 38 includes vertical plate 35, the side edges of which move freely in two inner vertical elongated tracks or grooves 36 formed in uprights 18 and 19 of horizontally movable carriage 16. The counterweight support includes a horizontal shelf 38 having a vertical rod 39 attached thereto. A plurality of suitably sized counterweights 40 each having a centered hole therein were placed over the rod 39 on shelf 38 to precisely counterbalance the vertically movable second carriage 28 and a picture support assembly 25 and a frame-supported canvas (not shown) supported thereon. The carriage 28 and the picture support assembly 25 are easily movable vertically in the directions of arrows 31 and horizontally in the directions of arrows 41, by simply grasping an edge of the supported painting canvas or an edge of the picture support assembly 25 and pushing it to the desired position in front of the painter.

There is sufficient friction associated with the cable and pulley arrangement and with the horizontal and vertical tracks and upright guides 32 to cause the canvas and picture support assembly 25 to remain in the position to which it is moved. The friction is low enough, however, that moving the picture can be easily accomplished without application of more than a bit of force urging the horizontal and vertical carriages to move as desired.

At the bottom end of uprights 18 and 19 of horizontally movable carriage 16, a cross-member 22 is attached. At the bottom of cross-member 22, a narrow vertical elongated tongue 21 extends into guide groove 13, to always maintain the vertical orientation of upright members 18 and 19 of horizontally movable carriage 16 (or to maintain the slightly inclined alternate orientation thereof shown in FIG. 3).

As best shown in FIG. 10, one or two castor assemblies can be provided on the bottom of tongue 21 to ride along the bottom of groove 13 and support a portion of the weight of horizontally movable carriage 16. In FIG. 10, roller 66 is supported by means of a pin attached to bracket 66A, which is attached to the bottom of tongue 21. Roller 66 rolls horizontally along the bottom of groove 13. Alternately, if all of the weight of horizontally movable carriage 16 and the weight supported thereby is supported on roller assemblies 56 and track 4 of the horizontal rail 3, the arrangement of FIG. 7 could be utilized, wherein roller 67 is supported by a pin extending downward from plate 67 attached to the bottom of tongue 21. The roller 67 would engage the sides of groove 13, preventing tilting of the uprights 18 and 19 of horizontally movable carriage 16.

Figure 2:
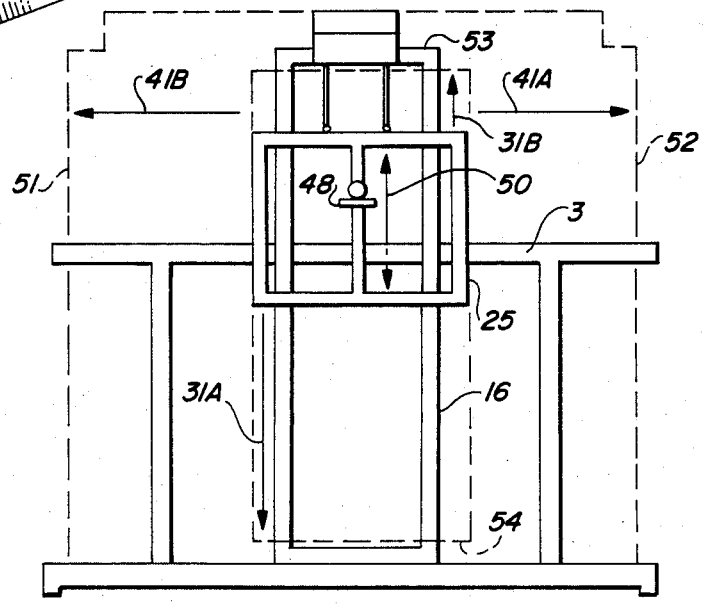
FIG. 2 is a simplified plan view diagram useful in explaining the horizontal and vertical adjustability of the painting canvas support assembly of the easel of FIG. 1.

As indicated in FIG. 2, a user can easily move picture support assembly 25 vertically in the directions of arrows 31A and 32B anywhere between horizontal dotted lines 53 and 54, and can also move the picture support assembly 25 horizontally in the directions of arrows 41A and 41B anywhere between vertical dotted lines 51 and 52. The upper canvas clamp member 48 can be vertically positioned anywhere in the track 46, as indicated by arrows 50.

Next, certain details of the picture support assembly 25 are described with reference to FIGS. 1, and 3–6. The frame of picture support assembly 25 includes a rectangular frame 25A, the upper member of which is attached by means of hinges 27 to the upper portion of vertically movable carriage 28 by hinges 27. Several vertical webs 44 extend between the horizontal upper and lower members of frame 25A. A shelf 26 for supporting the bottom edge of the supported painting canvas is attached to the front bottom horizontal member of frame 25A. A vertical middle web member 45 supports a vertical track 46 consisting of a channel configuration with a pair of parallel flanges defining a vertical groove 46A therein.

An upper canvas clamp 48, vertically movable in the direction of arrows 50, is attached to an L-bracket 55, the vertical portion of which has a clearance hole through which a threaded stud 65 of a round knob 47 extends. A slidable nut 43 positioned inside the channel guide 46 is threaded onto the free end of threaded stud 65, which extends through groove 46A of channel 46. By loosening knob 47, bracket 48 can be easily raised or lowered to tightly clamp a canvas onto picture support assembly 25. A pair of saw-toothed gripping members 58 provided on the bottom of upper clamp member 48 and on the upper surface of canvas support shelf 26 and a pair of saw-toothed edges 58A on support shelf 26 prevent any slippage of the painting canvas relative to picture support assembly 25 once the clamp 48 has been positioned an knob 47 tightened.

The plane of the supported painting canvas (not shown) and the plane of picture support assembly 25 can be tilted about a horizontal axis in the direction of arrows 67 (FIG. 3) about hinges 27 by loosening a thumb screw 30A (FIG. 3) and allowing arcuate bracket 30 to be adjusted.

The above-described easel is preferably constructed to have dimensions that are large compared to typical easels, to allow painting canvases as large as about five feet by six feet to be conveniently supported thereon and be positioned so that any portion of the painting canvas can be positioned in front of a painter sitting on a stool, such as a drafting stool or the like. For example, in the described prototype of the invention, horizontal members 9 and 10 of base 2 are five feet long. Struts 5 and 7 are six feet high, and horizontal rail 3 is six feet long. Uprights 18 and 19 of horizontally movable carriage 16 are about seven to ten feet high. The heighth and width of picture support assembly 25 is approximately five feet by four feet.

The above-described easel is utilized by clamping the desired canvas on picture support assembly 25 as described above and placing enough counterweight 40 on counterweight support shelf 38 to effectively counterbalance the vertically movable carriage 28 and the picture support assembly 25A and the painting canvas. The artist then can easily position any area of the canvas directly in front of him. This can be a great advantage, because it allows the artist to avoid the need to use stepladders, stepstools or the like to reach upper areas of a large painting and encourages the artist to work more rapidly and freely. The described easel, if constructed on a smaller scale, could very useful to ill or immobilized artists who must work from a stationary position.

Although the initial prototypes that I have constructed have been made of finely finished hardwood for the main structural members, obviously other materials, such as plastic or extruded aluminum members could be utilized.

While the invention has been described with reference to a particular embodiment thereof, those skilled in the art will be able to make various modifications to the described embodiment of the invention without departing from the true spirit and scope thereof. For example, the track 4 could be supported on the base 2, and the rail 4 could serve as a guide to prevent forward or backward tilting of the first carriage. As another example, carriage 28 can be split into two separately vertically movable carriages each having a separate linkage connected to support a drafting table surface, wherein the inclination of the drafting table surface is controlled by the amount of separation between the two vertically movable carriages; another linkage can be provided between the two vertically movable carriages to maintain their selected separation.

I claim:

1. An easel comprising means for allowing an artist to easily move any area of a supported canvas directly in front of the artist, including in combination:

(a) a horizontal track and means for supporting the horizontal track in a fixed location above a support surface;

(b) a first carriage and means for supporting the first carriage on the track and allowing linear horizontal movement of the first carriage to the right of left on the track;

(c) a second carriage and means for suppoting the second carriage on the first carriage and allowing vertical movement of the second carriage upward or downward on the first carriage;

(d) means for linearly guiding vertical movement of the second carriage on the first carriage;

(e) means for supporting the canvas to be presented to the artist in fixed relationship to the second carriage;

(f) means attached to the first and second carriages for counterbalancing the weight of the second carriage, canvas supporting means, and supported canvas;

(g) means for producing a first amount of friction between the vertical movement guiding means and the second carriage that is both (1) sufficiently large to prevent unintended vertical movement of the second carriage and the canvas due to small ordinary forces applied to the canvas while it is being painted and (2) sufficiently small to allow the artist to easily raise or lower the second carriage and the canvas merely by gently urging the second carriage upward or downward; and (h) means for producing a second amount of friction between the horizontal track and the first carriage that is both (1) sufficiently large to prevent unintended horizontal movement of the first carriage and the canvas due to small ordinary forces applied to the canvas while it is being painted and (2) sufficiently small to allow the artist to easily move the first carriage, the second carriage, and the canvas to the right or left.

2. The easel of claim 1 wherein the means for supporting the track includes a horizontal rail and a plurality of struts supporting the rail on a base, wherein the means for supporting the first carriage includes a plurality of rollers rolling on the horizontal track and a plurality of brackets rotatably supporting the respective rollers and rigidly attached to the first carriage.

3. The easel of claim 2 wherein the second carriage includes first and second upright members and means for rigidly attaching the first and second upright members in fixed relationship to each other, wherein the means for supporting the second carriage includes a first and second generally vertical guides disposed in fixed relationship to the first and second upright members, the counterbalancing means including a counterweight support, the counterweight support having means cooperating with the first and second generally vertical guides for effecting generally vertical, linear, sliding movement of the oounterweight support with respect to the first and second generally vertical guides.

4. The easel of claim 3 wherein the first and second generally vertical guides include first and second grooves disposed in the inner surfaces of the first and second upright members, respectively, and wherein the counterbalancing means includes a generally vertical plate having opposed edges extending into the first and second grooves, respectively, and also includes a horizontal counterweight support shelf on which counterweights can be stacked to counterbalance the weight of the second carriage means, picture support means, and supported canvas.

5. The easel of claim 4 including lower guide means disposed in fixed relationship to the base for linearly guiding a lower portion of the first carriage means to prevent tilting of the first carriage means during horizontal movement thereof on the horizontal track.

6. The easel of claim 4 including lower track means disposed in fixed relationship to the base for supporting and linearly guiding the lower portion of the first carriage means to prevent forward or rearward tilting of the first carriage during left or right horizontal movement thereof on the track.

7. The easel of claim 4 wherein the counterbalancing means includes first and second pulleys rotatably attached in fixed relationship to the upper end portions of the first and second upright members, respectively, and first and second cables passing over the first and second pulleys, respectively, a first end of each of the first and second cables being attached to the second carriage and a second end of each of the cables supporting the the counterweight support.

8. The easel of claim 7 wherein the canvas support means includes an upper horizontal member hingeably attached to the second carriage, a lower shelf for supporting the lower edge of the canvas, and a canvas clamp for engagement with an upper edge of the canvas.

9. The easel of claim 8 including a plurality of teeth on a lower surface of the canvas clamp for engaging the upper edge of the canvas.

10. The easel of claim 9 including an adjustable bracket connected between the picture support means and the second carriage to facilitate tilting of the supported canvas.

11. The easel of claim 7 wherein the friction of the roller supporting the first carriage on the horizontal track and the friction associated with the first and second grooves guiding vertical movement of the second carriage and the friction associated with the pulleys are sufficiently large to prevent unintended horizontal or vertical movement of the supported canvas, and is low enough to allow movement of the supported canvas to various desired locations without undue force.

12. The easel of claim 3 wherein the means for linearly guiding the vertical movement of the second carriage on the first carriage include a pair of upright members disposed on opposite outer sides of the first and second upright members of the first carriage.

13. A method of moving a supported canvas to position a selected area thereof directly in front of an artist, the method comprising the steps of:

(a) providing a horizontal track, a first carriage, and means for movably supporting the first carriage on the horizontal track, a second carriage, and means for movably supporting the second carriage on the first carriage in vertical relationship thereto, and counterbalancing means attached to the first and second carriages for counterbalancing the weight of the second carriage and the supported canvas;

(b) including a sufficient number of counterweights in the counterbalancing means to cause the weight of the counterbalancing means to approximately equal the weight of the second carriage and the supported canvas; and (c) gently urging the supported canvas and/or the second carriage to move the second carriage vertically and the first carriage horizontally to position the selected area of the supported canvas immediately in front of the artist.

14. An easel comprising means for allowing an artist or draftsman to easily move any area of a supported canvas or drawing surface directly in front of the artist or draftsman, including in combination:

(a) a horizontal track and means for supporting the horizontal track in a fixed location above a support surface;

(b) a first carriage and means for supporting the first carriage on the track and allowing linear horizontal movement of the first carriage to the right or left on the track by gently urging the first carriage to the right or left;

(c) a second carriage and means for supporting the second carriage on the first carriage and allowing vertical movement of the second carriage upward or downward on the first carriage by gently urging the second carriage upward or downward;

(d) means for linearly guiding vertical movement of the second carriage on the first carriage;

(e) means for supporting the canvas or drawing surface to be presented to the artist or draftsman in fixed relationship to the second carriage; and (f) means attached to the first and second carriages for counterbalancing the weight of the second carriage, canvas or drawing surface supporting means, and supported canvas or drawing surface.

* * * * *